US005252985A

United States Patent [19]

Christinsin

[11] Patent Number: 5,252,985

[45] Date of Patent: * Oct. 12, 1993

[54] WHIP TILT ADAPTER

[76] Inventor: Alan S. Christinsin, 1201 Dawn Dr., Belleville, Ill. 62220

[ * ] Notice: The portion of the term of this patent subsequent to Sep. 1, 2009 has been disclaimed.

[21] Appl. No.: 817,497

[22] Filed: Jan. 7, 1992

Related U.S. Application Data

[63] Continuation-in-part of Ser. No. 612,384, Nov. 14, 1990, Pat. No. 5,144,326.

[51] Int. Cl.[5] ..... H01Q 3/02; H01Q 1/32; H01Q 1/12

[52] U.S. Cl. ..... 343/880; 343/882; 343/888; 343/715

[58] Field of Search ..... 343/880, 715, 888, 882, 343/711, 712, 878, 881

[56] References Cited

U.S. PATENT DOCUMENTS

| | | | |
|---|---|---|---|
| 2,934,764 | 4/1960 | Noll et al. | 343/876 |
| 2,966,678 | 12/1960 | Harris | 343/879 |
| 2,979,720 | 4/1961 | Leonard | 343/805 |
| 3,304,037 | 2/1967 | Candela | 248/44 |
| 3,626,421 | 12/1971 | Santana | 343/900 |
| 4,055,845 | 10/1977 | Ladrick | 343/715 |
| 4,074,271 | 2/1978 | Sakuma | 343/715 |
| 4,101,897 | 7/1978 | Morrison | 343/715 |
| 4,109,251 | 8/1978 | MacDougall | 343/715 |
| 4,243,989 | 1/1981 | Piper | 343/715 |
| 4,625,213 | 11/1986 | Horn | 343/715 |
| 4,804,973 | 2/1989 | Ackman | 343/888 |
| 4,827,273 | 5/1989 | Friedberg et al. | 343/715 |
| 4,893,130 | 1/1990 | Metivier | 343/715 |
| 4,914,450 | 4/1990 | Dilley et al. | 343/895 |
| 4,916,456 | 4/1990 | Shyu | 343/715 |
| 5,144,326 | 9/1992 | Christinsin | 343/906 |

OTHER PUBLICATIONS

Holt, "We Tried It and It Worked, The Continuing Saga of MRC-107/108 HF" (1988).

Christinsin, "ASOC HF Communications" (1987).

Christinsin, "Using The Whip-Tilt Adapter (NVIS Adapter) in the Field" (1990).

*Primary Examiner*—Rolf Hille

*Assistant Examiner*—Hoanganh Le

*Attorney, Agent, or Firm*—Dickstein, Shapiro & Morin

[57] ABSTRACT

A whip-tilt adapter allows a whip antenna designed for use over the 2-30 MHz frequency band known as the high frequency (HF) radio band that is normally vertically polarized to be horizontally polarized for use in near vertical incidence skywave (NVIS) communication. The adapter has a vertical shaft for connection to an antenna mount or a bottom section of the antenna, a near-horizontal member having a port to connect to the antenna, and optionally a vertical port for an antenna connection. The adapter can be made to mate with any whip and whip base.

23 Claims, 6 Drawing Sheets

FIG. 7
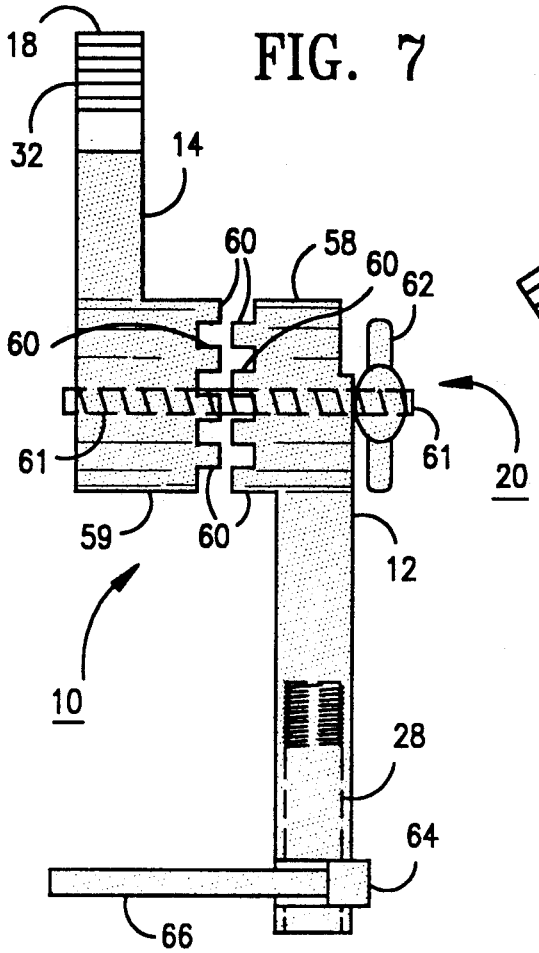
FIG. 13
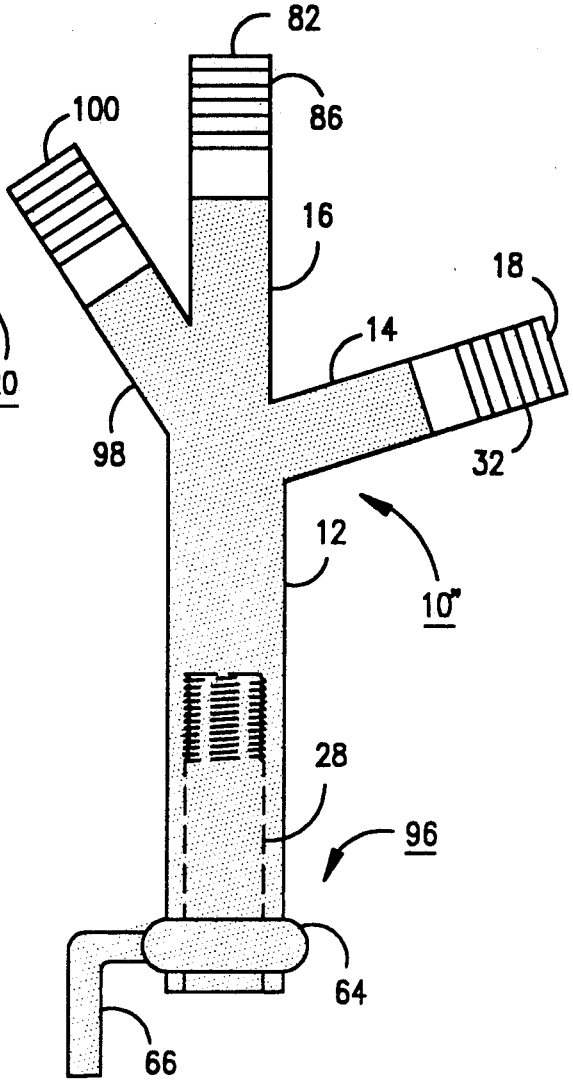
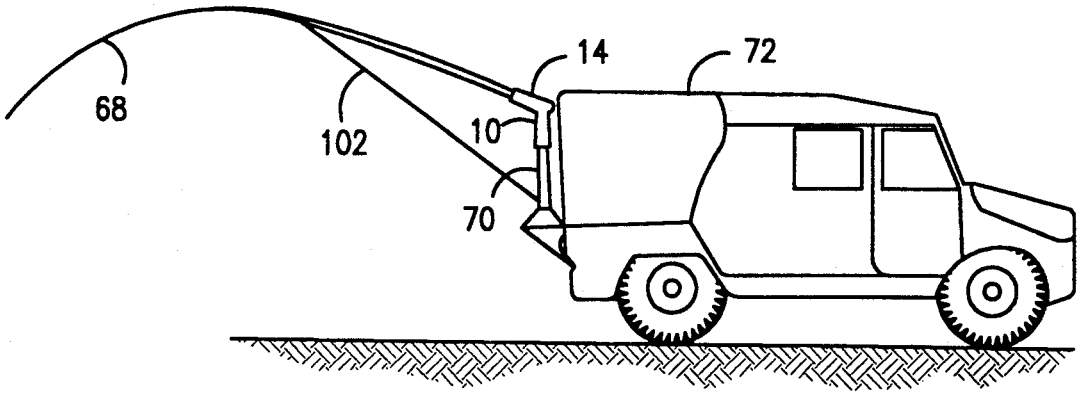
FIG. 8

WHIP TILT ADAPTER

This is a continuation-in-part of pending U.S. patent application Ser. No. 07/612,384, filed Nov. 14, 1980, now U.S. Pat. No. 5,144,326, issued Sep. 1, 1992, the entire disclosure of which is incorporated herein by reference.

BACKGROUND OF THE INVENTION

Most military vehicles that are employed with tactical units and transmit and receive communications by high frequency (HF) radio typically utilize tapered flexible vertical antennas called "whips". The most common whips consist of four 4 foot sections (16 foot whip) for use while the vehicle is moving, or eight 4 foot sections (32 foot whip) for use when the vehicle is stationary, referred to as "at-halt" operation. The sections are typically disconnected and stored in a canvas bag or the like during non-use, and are joined with threaded fittings during use. The bottom section has a threaded fitting for attachment to an antenna mount which is attached to a vehicle or shelter.

The vertical orientation of a whip is practical for vehicle mounting and useful for short distance ground wave (also known as surface wave) communications. However, certain intermediate distance communications requires that NVIS (near vertical incidence skywave) propagation modes be employed.

NVIS propagation involves refraction of radiated radio signals off the ionosphere at angles near 90° above the horizontal. High frequency radio signals emitted at high vertical radiation angles are reflected/refracted from the ionosphere at acute angles and return to earth at short and medium distances with usable signal intensity. As a practical matter, NVIS propagation can only be accomplished within the high frequency radio portion of the radio spectrum (about 2–30 MHz). The best results are achieved within the lower frequency portion of the HF band (2–14 MHz). NVIS propagation using the ionosphere cannot be employed with frequency signals greater than about 20 MHz.

NVIS is particularly effective where the participating net stations are spread over geographical areas within approximately 300 miles of each other. For example, if HF radio stations operating on lower HF frequencies (2 to 14 MHz) radiate signals at between 90 degrees (directly overhead) to approximately 45 degrees, the signals will return to earth with considerable strength out to approximately 300 miles (480 kilometers) of the transmitting station.

To produce adequate signal levels at these high angles, sending and receiving antennas optimally should be horizontally polarized. However, the whip antenna, in its normal position, is vertically polarized, i.e., the electrostatic field is perpendicular to the Earth and the electromagnetic field is parallel to the Earth, thus producing low signal levels at high angles. The vertical radiation pattern of a vertical whip operating in the HF radio band has the highest gain at angles below 45 degrees above the horizon. The antenna thus performs fairly well when used for ground wave communication (short distances, usually under 25 miles), but poorly at high radiation angles necessary for NVIS communication.

One method of providing some horizontal polarization for NVIS operation is to bend the whip from the vertical toward the horizontal position to the maximum extent possible. However, because the bottom whip sections are rigid and spring mounts (when used) are stiff, it is difficult to bend the lower sections of the whip to a near-horizontal position where maximum current and radiation occurs. Also, lower whip sections and springs often break when bent too far.

Adjustable antennas for vehicles are known in the art. U.S. Pat. Nos. 4,109,251, 4,243,989, 4,827,273, 4,101,897, 4,055,845 and 4,074,271 each disclose an adjustable antenna mounted on a vehicle. However, the antennas used in the mountings disclosed in these patents are not for high frequency whip antennas. Further, these types of tiltable antennas are quite small and are intended for use at very high (VHF) and ultra high (UHF) frequencies which would normally support antennas no more than about 36 inches long. It would be impractical to use the types of antennas disclosed in the above-mentioned patents in place of the standard HF whip antenna. Also, systems for transmitting VHF and UHF frequency radio waves do not rely on and are not designed for reflection/refraction of such waves off the ionosphere. Therefore, these patents do not suggest tilting antennas for the purpose of utilizing NVIS propagation.

U.S Pat. Nos. 2,934,764, 2,979,729 and 4,625,213 each disclose mounts for antennas. The mounts hold an antenna to a surface in a fixed orientation, and do not provide for easy transition between vertical and horizontal polarization. Further, the disclosed mounts cannot in any way be substituted for a mount on an existing high frequency radio whip antenna connection. Also, none of the patented devices are practical for the exploitation of NVIS propagation phenomena peculiar only to HF radio communication, which is the intended use of the present invention.

There is therefore a need to provide a method and simple and inexpensive device for changing the polarization of an HF radio whip antenna between vertical and horizontal without requiring replacement of the vehicle's existing whip mount or other radio components.

SUMMARY OF THE INVENTION

This need is met by an adapter to which a whip antenna can be fitted in a near-horizontal position (thereby producing horizontal polarization) and in a vertical position, and preferably also in a variety of in-between positions. The electrically conductive L-shaped adapter has a vertical shaft, a near-horizontal member which may swivel or be manually removed and inserted into another position, means for securing the vertical shaft to the mounting base (or a bottom section of the whip antenna) and a port on the upper or distal portion of the near-horizontal member allowing for insertion of the whip antenna section. The means for securing the vertical shaft to the base of the antenna, which is in turn secured to the antenna mount, are located at the lower end of the vertical shaft. The near-horizontal member is connected to the upper end of the vertical shaft. The whip antenna port is located at the end of the near-horizontal member distal from the vertical shaft. In other embodiments, a second whip port is located either at the end of the near-horizontal member proximal to the vertical member or at the upper end of the vertical shaft. The second port may be formed in either the near-horizontal member or vertical shaft or the port may be formed in a vertical post extending from the junction of the vertical shaft and near-horizontal member.

With the adapter, the antenna's polarization can be changed quickly and the vehicle's existing radio antenna coupler and whip can be used for either ground wave or NVIS operation with frequencies of about 2-30 MHz, preferably 2-14 MHz.

The present invention is designed for use with HF radio whip antennas on NVIS operation preferably over the lower portion of the HF band (preferably about 2-14 MHz) by utilizing the reflective/refractive physics of the ionosphere. Accordingly, the present invention provides an adapter (not an antenna and not an antenna base) which can be used with existing whips, whip bases and radio equipment already in a vehicle, and which can be used to tilt an HF radio whip antenna to a position lower than 45° from horizontal, and preferably near-horizontal.

BRIEF DESCRIPTION OF THE DRAWINGS

FIG. 7 is a front elevational view of the adapter of FIG. 6.

FIG. 8 illustrates the use of an adapter of the present invention with a rear-tilt antenna.

FIG. 13 is a schematic side elevational view of a three port adapter in accordance with the present invention.

DETAILED DESCRIPTION OF PREFERRED EMBODIMENTS

Figure 1:
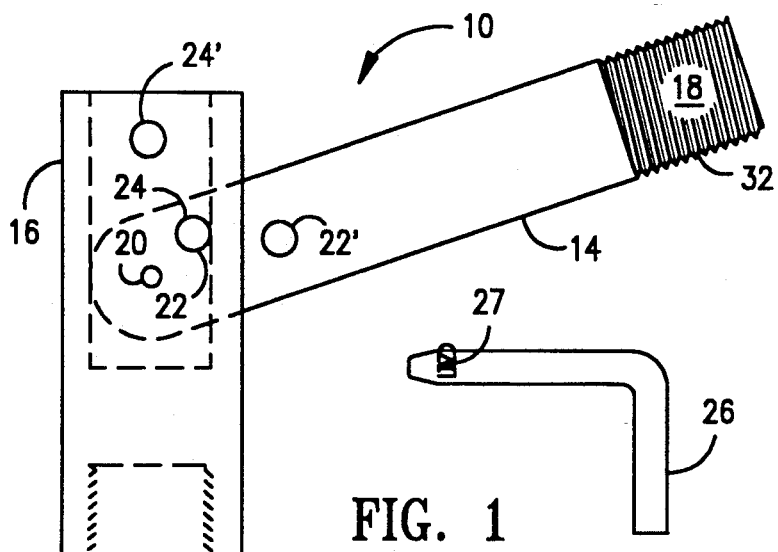
FIG. 1 is a schematic side elevational view of a single port adapter having a pivotable near-horizontal member and a securing pin.

A whip tilt adapter 10 constructed in accordance with a first embodiment of the invention is illustrated in FIG. 1. The adapter 10 has a vertical shaft 12 and a near-horizontal member 14. The near-horizontal member 14 is attached to the upper end 16 of the vertical shaft 12 and distally terminates in a horizontal port 18. The near-horizontal member 14 is pivotably attached to the vertical shaft 12 by a pivot means 20. That is, the near-horizontal member 14 is attached to the vertical shaft 12 such that the near-horizontal member 14 moves, by pivoting, from a near-horizontal position (illustrated in FIG. 1) to a vertical position (with the member 14 being generally aligned with the vertical shaft 12). The near-horizontal member 14 contains at least one set of holes 22 which corresponds to at least one set of holes 24 on the vertical shaft 12. The near-horizontal member 14 is held stationary with respect to the vertical shaft 12 by a securing means.

In the embodiment illustrated in FIG. 1, the securing means is formed of a pin 26 which is inserted through the matching sets of holes 22, 24, i.e., through the near-horizontal member 14 and the vertical shaft 12. For NVIS operation, the near-horizontal member 14 is in the position illustrated in FIG. 1 and the pin 26 is inserted through the holes 22, 24 located closest to the pivot means 20. For surface wave communications, the pin 26 is removed from the holes 22, 24 (in a direction perpendicular to the plane of the drawing), then the member 14 is rotated about the pivot means 20 until the member 14 is generally vertical (i.e., parallel to the vertical post 12), and then the pin 26 is inserted into holes 22', 24' located relatively farther away from the pivot means 20. Preferably, the pin 26 is held within the holes 22, 24, 22', 24' by a compression spring detent 27.

The vertical shaft 12 may include a bore 28 at its lower end 30. The bore 28 has internal threads which match external threads at the top of the whip mount (or at the top of a first whip section) and thus vary with the specific thread configuration of antenna with which the adapter 10 is used.

The horizontal port 18 is formed with external threads 32 that are compatible with the threads of the bottom of the section of the whip being used. In operation, the whip tilt adapter 10 is attached to a whip, either between the bottom sections or between the whip and the antenna mount or between the whip sections. For practicing the present invention, the whip antenna is preferably from 8 feet to about 32 feet long. The mount may be stationary or mobile, e.g., on a shelter or a vehicle.

Figure 2:
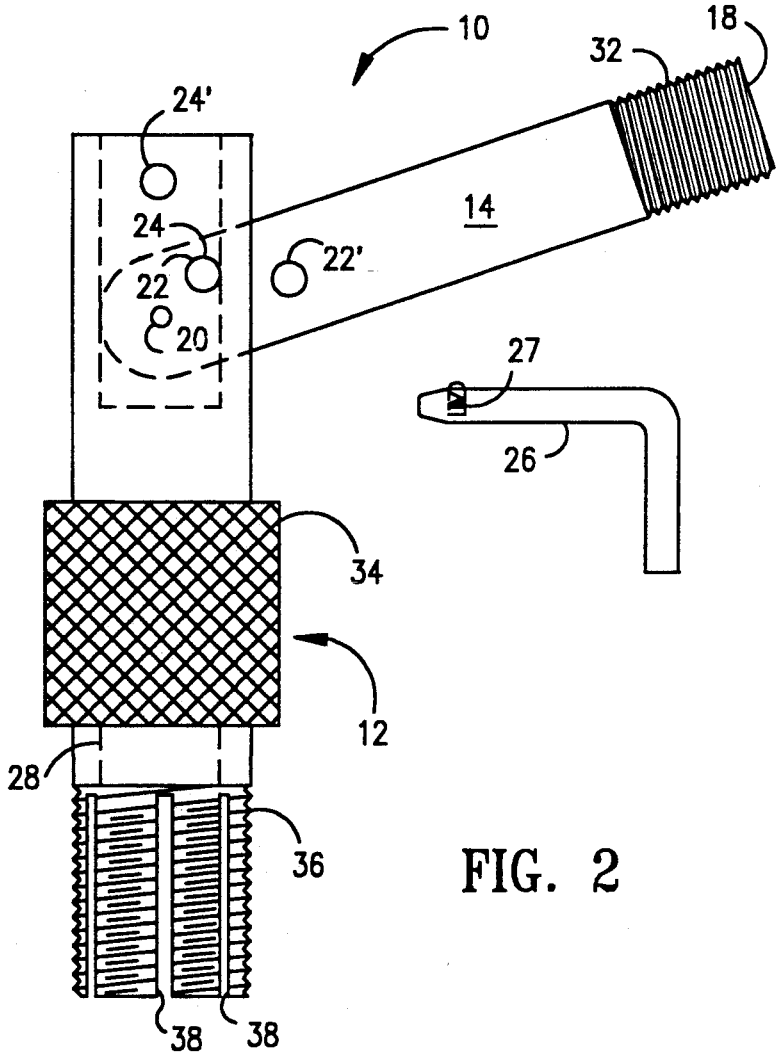
FIG. 2 is a schematic side elevational view of a single port adapter having a pivotable near-horizontal member and an internally threaded knurled compression ring.

In an alternative embodiment, as shown in FIG. 2, the vertical shaft 12 may be secured to the top of a whip section or on the whip mount by a knurled compression ring 34 which prevents the adapter 10 from moving. The compression ring 34 is internally threaded. The internal threads mate with threads 36 on the end of the vertical shaft 12. Additionally, the threaded portion 36 of the vertical shaft 12 is slotted 38, i.e., cut to allow for greater and more secure compression of the shaft 12 onto the base or antenna section.

Figure 6:
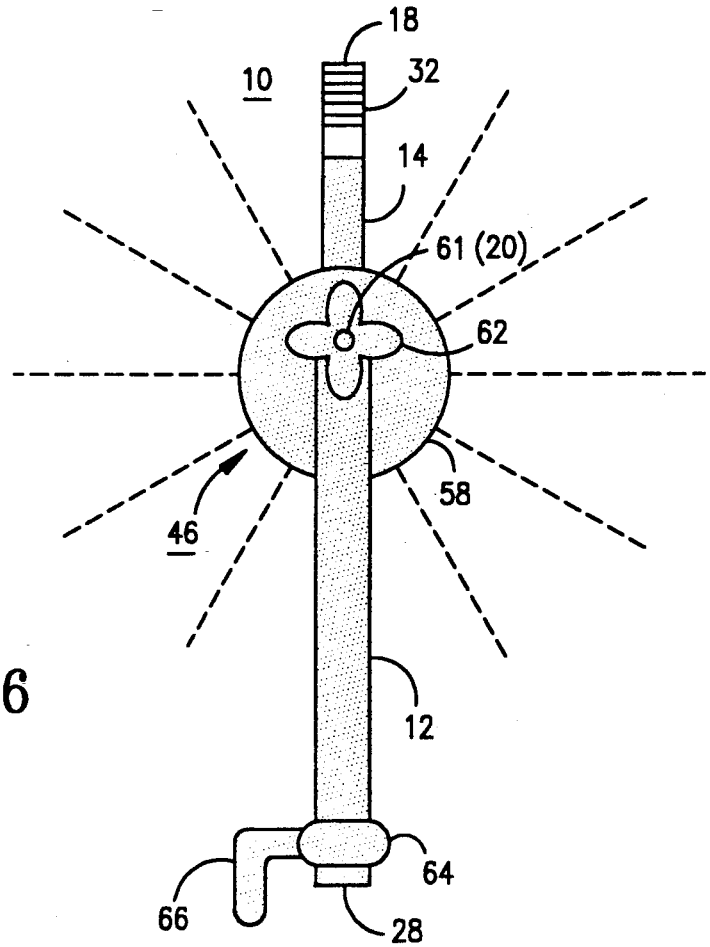
FIG. 6 is a schematic side elevational view of a single port adapter having a pivotable near-horizontal member which is positionable at an infinite number of positions by mating plates.
Figure 11:
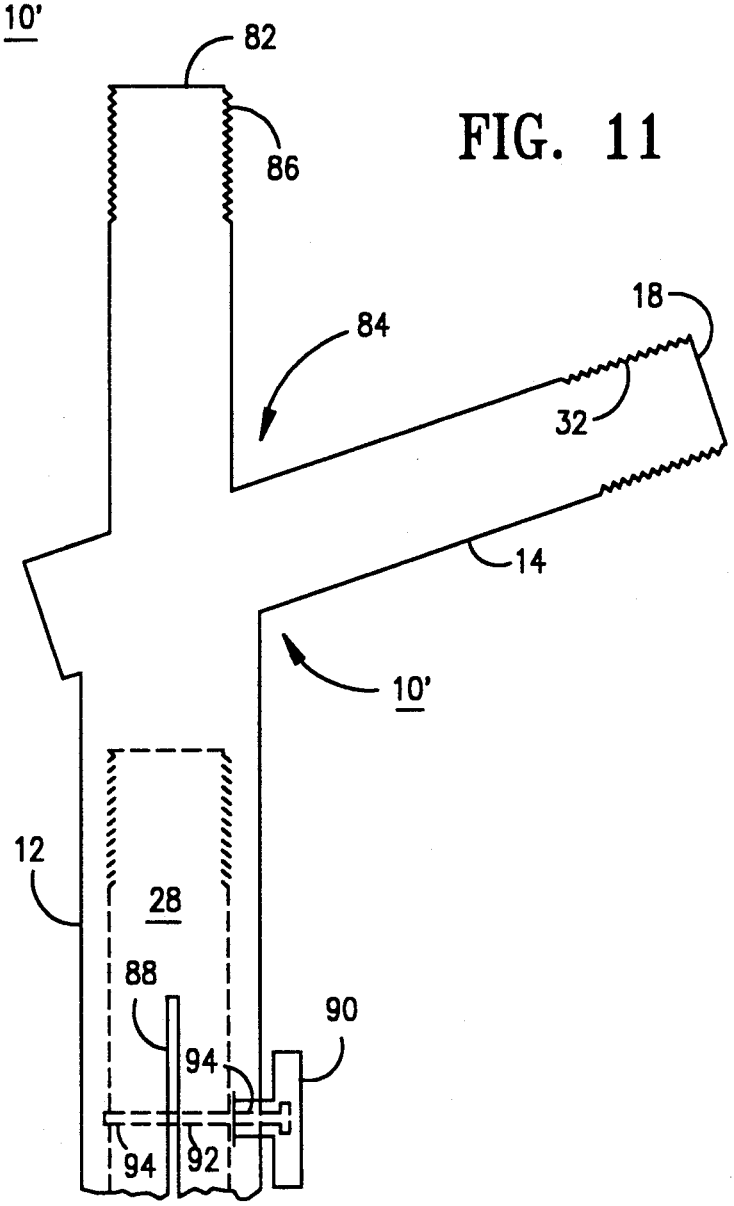
FIG. 11 is a schematic side elevational view of a two port adapter having a clamp and pin as securing means.

In other, alternative embodiments, the vertical shaft 12 may be secured through a locking mechanism, preferably a collar, which compresses the vertical shaft 12 onto the lower whip section or base. An example of such a collar is illustrated in FIG. 6. Another alternative to the compression ring 34 is the use of a clamp connected to a pin. The pin fits through the slots of the shaft and causes compression of the shaft around the lower whip section or base when the clamp is tightened. An example of such a securing means is illustrated in FIG. 11.

Figure 3:
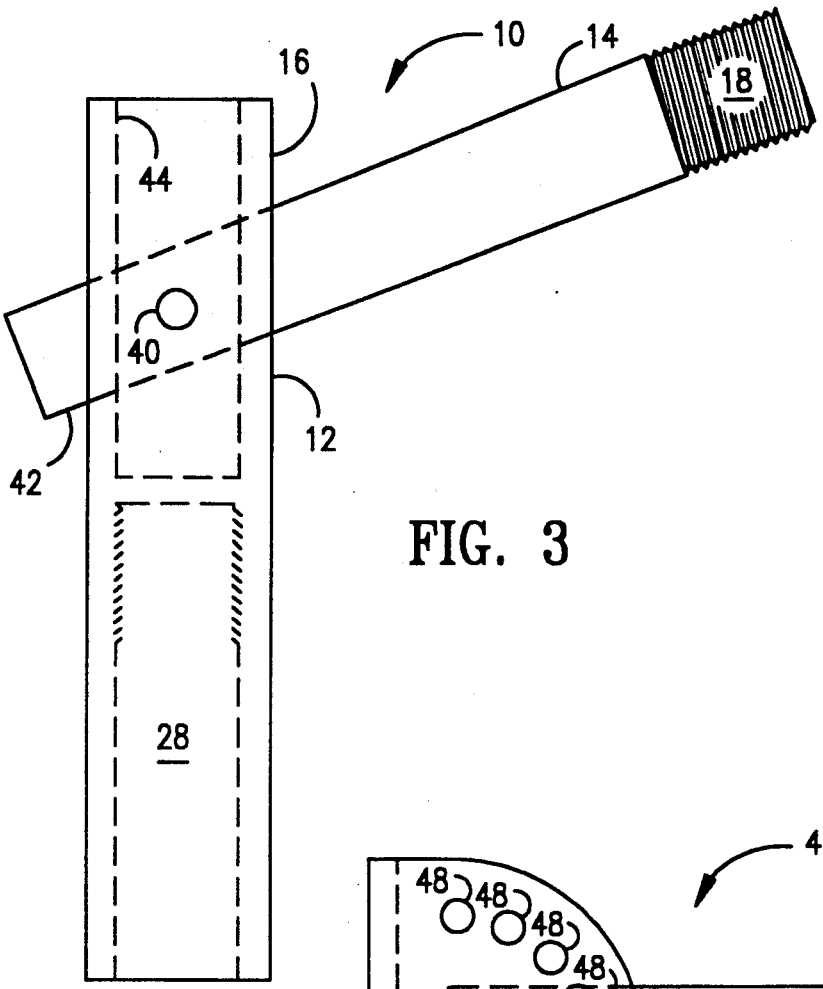
FIG. 3 is a schematic side elevational view of a single port adapter having a removable and insertable near-horizontal member.

Alternatively, the near-horizontal member 14 may not swivel but instead may be removed and inserted in other positions. As shown in FIG. 3, the near-horizontal member 14 and vertical shaft 12 each contain one set of matched holes 40. The vertical shaft 12 is configured such that the near-horizontal member 14 fits into designated positions, e.g., near-horizontal and vertical. In order to change the position of the near-horizontal member 14, it is manually removed and inserted into another position. For example, the member 14 can be moved from the near-horizontal position illustrated in FIG. 3 to a vertical position by separating the member 14 from the shaft 12 and then inserting the end 42 of the member 14 into a cavity 44 within the upper end 16 of the shaft 12. The near-horizontal member 14 is secured in position by a securing means, generally a pin which fits into the holes 40.

Figure 4:
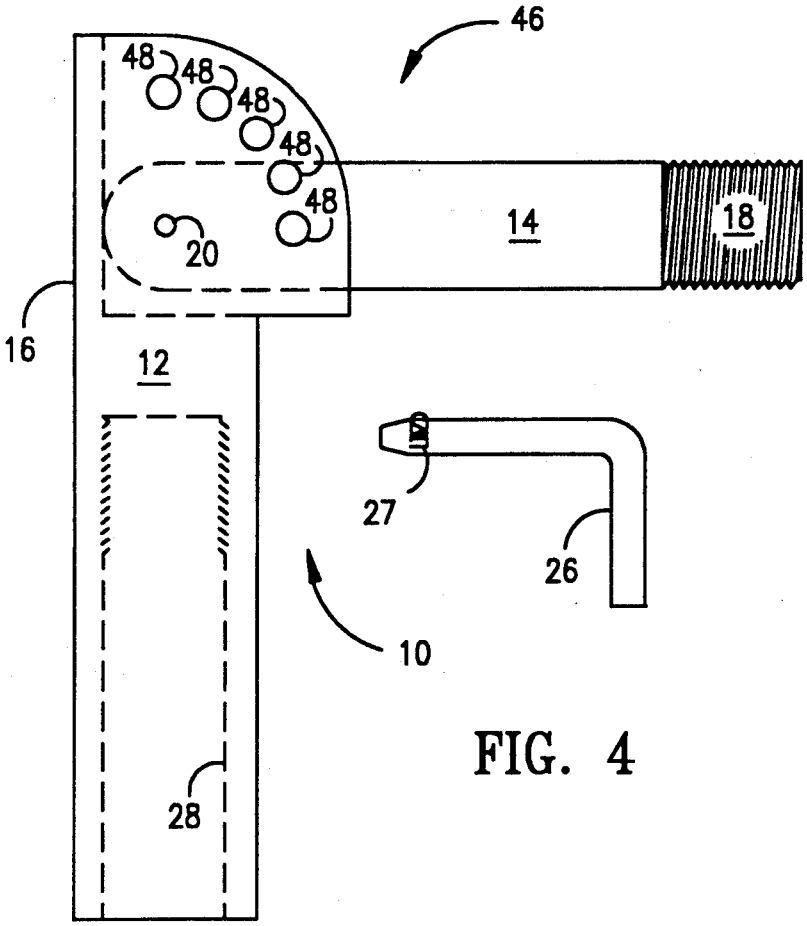
FIG. 4 is a schematic side elevational view of a single port adapter having a pivotable near-horizontal member and a position mechanism which has multiple position selections for the near-horizontal member.

Alternatively, the near-horizontal member 14 may be attached to the vertical shaft 12 by a multi-position mechanism 46, as depicted in FIGS. 4–7. As shown in FIG. 4, the multi-position mechanism 46 is located at the upper end 16 of the vertical shaft 12. The mechanism 46 may be integrally formed with the vertical shaft 12 and near-horizontal member 14 and may contain matched sets of holes 48. By swiveling the near-horizontal member 14 about a pivot means 20, a hole through the member 14 can be selectively aligned with selected ones of the holes 48 of the vertical shaft 12. The orientation of the near-horizontal member 14 may range from 0 to 180° (90°–180° not depicted in FIG. 4) depending on the position of the holes 48. The near-horizontal member 14 is secured in its selected position by a securing means. Preferably, the securing means is a pin 26 inserted through a selected one of the holes 48 and through the hole through the near-horizontal member 14.

Figure 5:
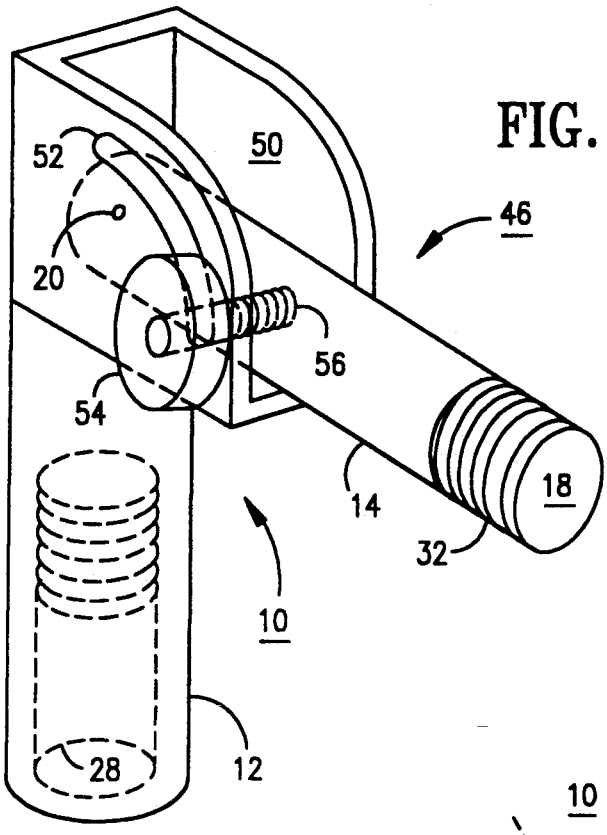
FIG. 5 is a perspective view of a single swivel port adapter having a pivotable near-horizontal member, a slot which allows for an infinite number of positions, and a clamping knob.

As shown in FIG. 5, the multi-position mechanism may be in the form of an arcuate slot mechanism 50 with a curved slot 52. The slot mechanism 50 allows the near-horizontal member 14 to attain an infinite number of positions and angles with respect to the vertical shaft 12. These angles are not limited to those depicted. The angles can range from horizontal, i.e., 90° to the vertical shaft 12 to vertical, i.e., 180° to the vertical post 12. In the embodiment illustrated in FIG. 5, the slot 52 replaces the holes 48 of the embodiment illustrated in FIG. 4. A clamping knob 54 with a pin 56 is inserted through the slot 52 and through a set of holes through the near-horizontal member 14. When the knob 54 is pressed tightly against the slot mechanism 50, the mechanism 50 is in turn pressed against the near-horizontal member 14, and the near-horizontal member 14 is secured in place.

As shown in FIGS. 6 and 7, the multi-position mechanism may alternatively be formed of two mating cylindrical plates 58, 59 internally faced with interfitting gear-like castellated teeth 60. Only one of the mating plates 58 can be seen in FIG. 6. This plate 58 is preferably integrally formed with (e.g., welded to) the post 12. The other plate 59 (FIG. 7) is essentially a mirror image of the first plate 58. The mating plate 59 is located behind the plate 58 such that the teeth 60 of the two plates 58, 59 mesh with each other. Preferably, the second plate 59 is integrally formed with (e.g., welded to) the near-horizontal member 14.

With the multi-position mechanism 46 illustrated in FIGS. 6 and 7, the near-horizontal member 14 can swivel about an axle 61 and be secured at positions ranging from 0° to 360° with respect to the post 12. The near-horizontal member 14 can be secured in any position by tightening a knob 62 threaded onto the axle 61 (which extends entirely through both of the mating plates 58, 59). Tightening the knob 62 pulls the plates 58, 59 together until the teeth 60 are engaged and interlocked with each other, such that the plate 59 cannot rotate with respect to the plate 58. When the knob 62 is loosened (as illustrated in FIG. 7) the plate 59 can be moved laterally away from the plate 58 and the member 14 can be rotated about the threaded axle 61. When the knob 62 is loosened, the near-horizontal member 14 can be moved to and then secured at a plurality of different angular orientations with respect to the post 12, including vertical. The adapter 10 depicted in FIGS. 6 and 7 also illustrates the use of a collar 64 with a tightening handle 66 for securing the vertical shaft 12 to a mounting base.

Figure 9:
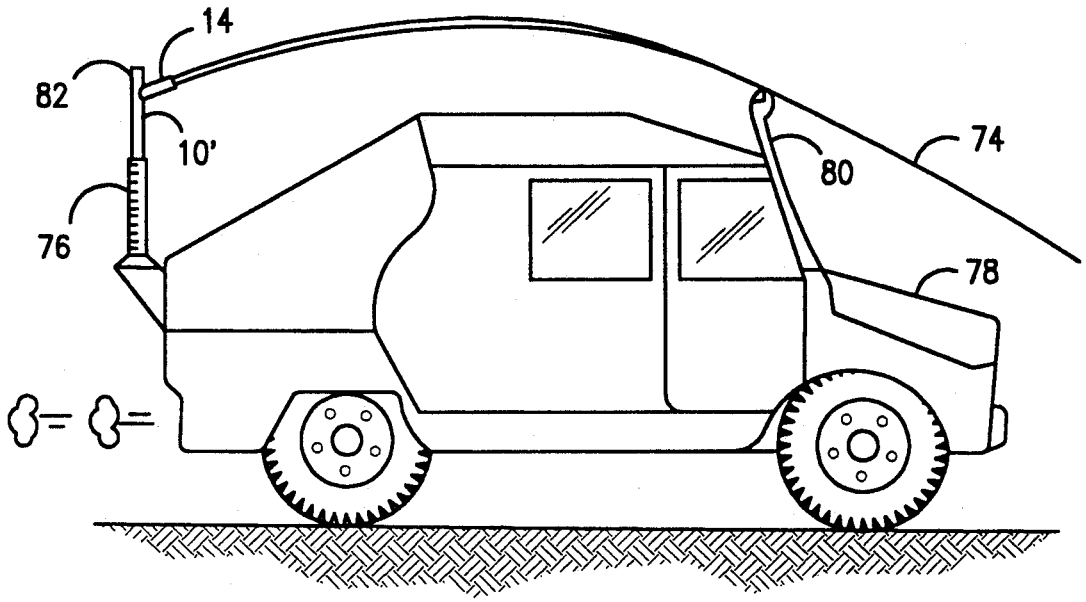
FIG. 9 illustrates the use of an adapter of the present invention with a forward-tilt antenna.

The lengths of the vertical shaft 12 and near-horizontal member 14 may vary. The lengths are generally determined by the type of vehicle with which the whip is to be used, or by other practical reasons. The lengths of the adapter's shaft and near-horizontal member must allow the whip to clear the vehicle if the whip is tilted forward, and not drag on the ground if the whip is tilted towards the rear. FIG. 8 shows the use of the adapter 10 for a rear tilt whip 68. The adapter 10 is mounted on an antenna mount 70 on the rear of he vehicle 72 with the whip 68 tilted away from the vehicle 72. FIG. 9 shows use of an adapter 10' for a forward tilt whip 74. In FIG. 9, the adapter 10' is mounted on an antenna mount 76 at the rear of the vehicle 78 with the whip 74 tilted towards the front of the vehicle 78. In the arrangement illustrated in FIG. 9, the antenna whip 74 is partially supported by a front support 80.

The angle formed between the near-horizontal member and the vertical member preferably can be optimized for the user/vehicle antenna onto which the adapter will connect. Generally, the angles employed are between 0 and 45 degrees above the horizontal. If the angle is greater than 45 degrees above the horizontal, the antenna loses its ability to become horizontally polarized and NVIS reception becomes more difficult. Usually, angles between 20–25 degrees above the horizontal are preferred as they allow for optimal radiation/reception at NVIS angles and afford the best practical mountings of the antenna with respect to the shelter or vehicle.

A preferred method of using the adapters 10 illustrated in FIGS. 4–7 is as follows: First, the adapter 10 is installed on a mounting base which is fixed to a vehicle or the like such that the post 12 is vertical. Then, the elongated member or arm 14 is positioned at a 90° angle with respect to the post 12, such that the arm 14 is horizontal. Then, while the arm 14 is horizontal, the long antenna whip is connected to the horizontal port 18. Then, while the whip is threaded onto the port 18, the arm 14 is rotated upwardly to an angle of about 22.5° above the horizontal, and secured in this near-horizontal position by the multi-position mechanism 46, 48, 50, 58–60. With this procedure, the whip can be easily installed onto the port 18, and the flexible whip can then be relatively easily rotated up by hand to a position which is optimum considering the desired polarization of the NVI radio waves and the need to keep the distal end of the whip off of the ground.

The adapter is preferably formed of a conductive material such as aluminum, stainless steel or brass stock and can be formed of machined tubes or cylinders welded together or from a single machined piece. Adapters from machined pieces are preferred simply because their manufacture is easier. By being electrically conductive, the adapter provides a radio frequency electrical connection between the whip sections that it joins. There is no discernible powerloss due in the adapter. Alternatively, the body of the adapter can be formed of poorly conductive or non-conductive material such as a high strength plastic. If the body of the adapter is formed of non-conductive material, then it is necessary to add some type of electrical connectivity means for establishing an electrical connection between the port and the antenna base.

Because the adapter is inserted into the antenna system at or relatively near the base, there is an inherent low voltage (shock) potential even with transmitters with power levels up to 400 watts. The adapters may be insulated to prevent personnel from touching the conductive metal portion. The adapter may be insulated by encapsulating it in plastic, fiberglass or other insulating material.

Figure 10:
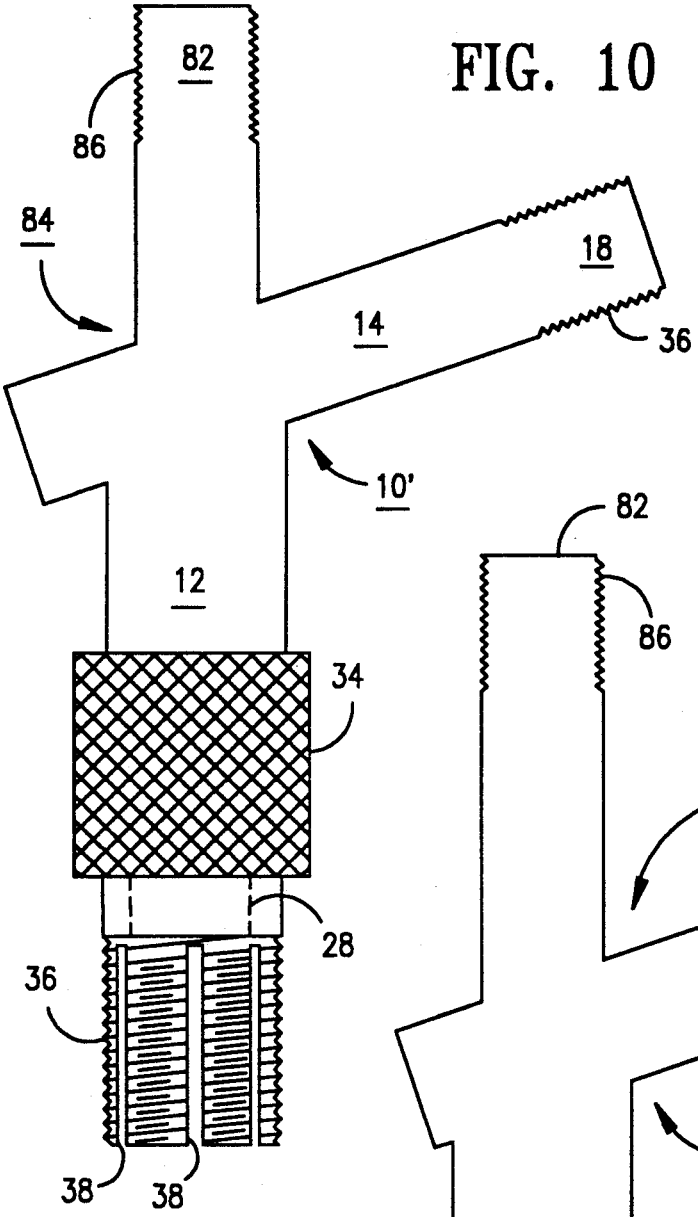
FIG. 10 is a schematic side elevational view of a two port adapter having as securing means a knurled compression ring that is internally threaded.

Another embodiment of the invention is illustrated in FIGS. 10–11. In addition to the features in the above-described embodiments, the adapter 10' shown in FIG. 10 has a second port 82 at an upper end of the vertical shaft 12. The second port 82 is located above a means 84 for securing the near-horizontal member 14 to the vertical shaft 12. In the embodiment illustrated in FIG. 10, the near-horizontal member 14 and the vertical shaft 12 are integrally attached (e.g., welded) to each other.

The vertical second port 82 may be formed with external threads 86 identical to the threads 36 of the first port 18, i.e., compatible with the internal threads of the bottom of the section of the whip being used.

In operation, the whip antenna can be unthreaded from the vertical port 82 and immediately threaded onto the near-horizontal port 18 for NVIS operation. For surface wave communications, the antenna can be threaded back onto the vertical port 82.

The two-port adapter 10' depicted in FIG. 10 has a securing means comprised of a knurled compression ring 34 which fits on the slotted and threaded vertical shaft end, identical to the arrangement illustrated in FIG. 2. The two-port adapter 10' depicted in FIG. 11 has a securing means comprising slots 88 and a control knob 90 with a threaded pin 92. Turning the knob 90 causes the pin 92 to move through threaded holes 94 causing compression of the slotted shaft 12 around the mounting base (or the lower antenna section).

A three port adapter 10'' is illustrated in FIG. 13. The adapter 10'' is formed of a vertical shaft 12 with a securing means 96 for securing the adapter 10'' to a support base (not illustrated in FIG. 13), an integral near-horizontal member 14 with a threaded horizontal port 18, an integral upper portion 16 with a threaded vertical port 82, and an integral intermediate arm 98 with its own threaded port 100. Depending on the configuration of the support base and the angle of the ground underneath the support base, one of the ports 18, 100 or 82 will support a whip antenna (not illustrated in FIG. 13) in an optimum position for radio wave propagation. For example, depending on the conditions, it may be the port 100 which will support the antenna in the most nearly horizontal position. Threads of the ports 18, 82 and 100 are preferably identical to each other. Thus, in operation, the whip antenna (not illustrated in FIG. 13) can be attached to any one of the ports 18, 100 and 82, so as to optimize performance according to the conditions encountered in the field.

In any of the embodiments described above, there is no specific requirement for the ports to be either male or female other than to mate with a particular type/-model of whip. Additionally, there is no requirement that the bottom of the vertical shaft 12 has either male or female threads. Both are dependent on the type of user/vehicle antenna to which the adapter will connect. For example, the threads may be Edison or SAE threads which are compatible with AT-1011 32/16 foot fiberglass antennas used by the United States Marine Corps and Air Force and the AN/PRC-104 HF man-pack radios, respectively.

Figure 12:
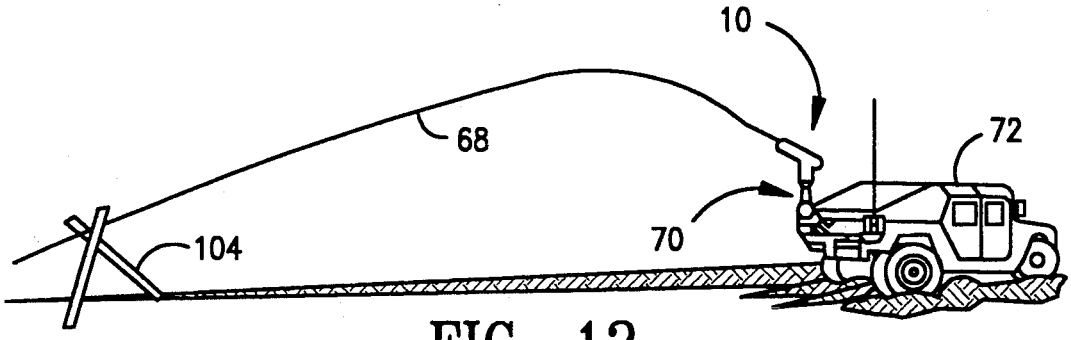
FIG. 12 illustrates the use of an adapter of the present invention with an antenna in an "at halt" position.

The whip tilt adapter of the present invention has the ability to convert a whip from a vertically polarized antenna to a horizontally polarized antenna. To use the adapter, the adapter is first connected to the mating antenna base or bottom whip section. The near-horizontal member is then pointed in the direction that the whip should lie and the whip is then connected to the horizontal port. When using the adapter for a forward-tilt antenna (FIG. 9), it may be desirable to tie the end of the whip to the front bumper, the fording kit, the windshield or other fixed points using nylon or other weather resistant, non-conductive rope or brackets 80. When using the adapter for a rear-tilt antenna (FIG. 8), it may be desirable to tie 102 the whip to the two rear sides of the vehicle to prevent it from flaying when the vehicle is moving. If the 32 foot whip is being used "at halt," the whip can be held in place (off the ground) by a cradle 104 (FIG. 12), which also helps to relieve the strain of the long antenna due to gravitational forces.

As used herein, the term "near-horizontal" means that most of the whip is in a near-horizontal plane. The natural arc of the whip, considering its length and weight, plays a large part with regard to the angle employed in the tilt adapter. For example, a 32 foot whip, with loading coil inserted, could require a 30° or higher tilt angle to allow the whip to lie in a near-horizontal plane and preclude the whip from dragging on the ground. The precise angle employed is designed to accommodate the practical and electrical characteristics of the whip and whip base being employed. Additionally, in some instances, the relationship of the placement of the whip base on a vehicle (shape, height and other characteristics of the vehicle chassis) and configuration of the ground plane require tilting the whip at somewhat higher or lower angles to obtain near-horizontal positioning. By adjusting the angle of tilt, NVIS performance can be optimized for any given vehicular application or ground conditions. The embodiments illustrated in FIGS. 4–7 are particularly well suited for adjusting the angle of the near-horizontal member 14 for optimization of NVIS performance.

Using a conventional, vertical whip antenna with the whip tilt adapter of the present invention eliminates the need to use expensive, bulky, large and mechanically difficult and time consuming solutions using antennas that are made of large diameter copper or aluminum tubing. Additionally, with respect to use on vehicles, the whip-tilt adapter allows the vehicle to function using near-vertical incidence with a physically flexible, electrically efficient, simple and inexpensive antenna.

The drawings and the foregoing description are only illustrative of preferred embodiments which achieve the objects, features and advantages of the present invention. It is not intended that the present invention should be limited thereto. Modifications of the preferred embodiments which come within the spirit and scope of the following claims are to be considered part of the present invention.

What is claimed as new and desired to be protected by Letters Patent of the United States is:

1. An adapter for connecting a whip antenna to an antenna base, wherein the whip antenna is designed for use in the 2–30 MHz HF radio band, said adapter comprising:

a) a first shaft having a lower end and an upper end;

b) a second shaft extending distally from said upper end of said first shaft, said second shaft having a first end distal from said first shaft;

c) means for securing said first shaft to said second shaft;

d) means for securing said lower end of said first shaft to the antenna base;

e) a first antenna port located at said distal end of said second shaft, said first antenna port including means for securing the whip antenna to said distal end of said second shaft, and wherein said means for securing said lower end of said first shaft to the antenna base is compatible with said means for securing the whip antenna to said distal end of said second shaft, whereby the whip antenna is securable directly to the antenna base;

f) means for establishing electrical connectivity between said port and the antenna base; and g) means for positioning said second shaft relative to said first shaft, said positioning means being located at said upper end of said first shaft.

2. The adapter of claim 1, wherein said positioning means comprises two mating plates having teeth, wherein said second shaft is positioned between said teeth, and wherein said plates are held together by a second securing means.

3. The adapter of claim 1, wherein said positioning means comprises an arcuate slot.

4. The adapter of claim 1, wherein said means for securing said first shaft to said second shaft comprises a locking pin.

5. The adapter of claim 1, wherein said means for securing said first shaft to the antenna base comprises a bore formed in said lower end of said first shaft, said bore having internal threads.

6. The adapter of claim 1, wherein said port includes external threads.

7. The adapter of claim 1, wherein said lower end of said first shaft is externally threaded and wherein said lower end of said first shaft has cuts which allow for compression of said lower end.

8. The adapter of claim 7, wherein said means for securing said first shaft to the antenna base comprises a knurled compression ring, wherein said ring is internally threaded with mating threads to the external threads of said lower end of said vertical shaft.

9. The adapter of claim 1, wherein said means for securing said first shaft to the antenna base comprises a clamping knob.

10. The adapter of claim 1, wherein said adapter further includes a third shaft extending distally from said upper end of said first shaft, said third shaft having a distal end, and a second antenna port located at said distal end of said third shaft, and means for establishing electrical connectivity between said second antenna port and the antenna base.

11. The adapter of claim 10, wherein said first, second and third shafts are integral with each other.

12. The adapter of claim 11, wherein said means for securing said lower end of said first shaft to the antenna base includes male threads, and wherein said first and second antenna ports include female threads.

13. A whip tilt adapter comprising:

a first member having a lower end and an upper end;

a second member extending distally from said upper end of said first member, said second member having a first end distal from said first member;

means for pivotably securing said second member to said first member;

a first antenna port located at said distal end of said second member; and means for positioning said second member in at least first and second positions relative to said first member, said second member being arranged to support a whip antenna in a near-horizontal position for NVIS HF radio wave propagation when said second member is in said first positoning relative to said first member, and said second member being arranged to support the whip antenna in a generally vertical position for surface wave communications transmission or for vertically polarized low angle long distance skywave propagation when said second member is in said second position relative to said first member, said positioning means being located at said upper end of said first member, and wherein said positioning means comprises a plate, a plurality of holes extending through said plate, at least one hole extending through said second member, and a pin for extending through said hole of said second member and through a selected one of said holes of said plate so as to selectively maintain said second member in a desired orientation with respect to said first member, said plate being fixedly connected to said first member.

14. The adapter of claim 13, wherein said first member includes a rigid vertical elongated shaft, and wherein said lower end of said first member includes means for securing said first member to a whip mount, and wherein said means for securing said first member to the whip mount includes threads.

15. The adapter of claim 14, wherein said pin is removable from said hole of said second member.

16. An HF radio transmission system, comprising:

(a) a whip antenna;

(b) generating means for generating HF radio waves; and (c) an adapter for selectively supporting said whip antenna in first and second positions and for electrically connecting said whip antenna to said generating means, wherein said first position is a near-horizontal position for NIVS transmission, and wherein said second position is a generally vertical position for surface wave communications transmission or for vertically polarized low angle, long distance (beyond 300 miles) skywave communication; and wherein said adapter comprises first and second ports for connecting said whip antenna to said adapter.

17. The HF radio transmission system of claim 16, wherein said adapter further comprises a third port for connecting said whip antenna to said adapter.

18. A method of using a whip antenna, said method comprising the steps of:

(a) using an adapter to support said whip antenna such that said whip antenna is in a first orientation;

(b) using said adapter to support said whip antenna such that said whip antenna is in a second orientation; and (c) while said whip antenna is in said second orientation, performing NVIS radio wave propagation by propagating HF radio waves from said whip antenna; and wherein said adapter includes a first and a second shaft, said second shaft being connected to said first shaft, and wherein said step of using said adapter to support said whip antenna such that said whip antenna is in said second orientation includes the step of connecting said whip antenna to said second shift; and wherein said adapter further includes a third shaft, said third shaft being connected to said first shaft, and wherein said first, second and third shafts are integral with each other, and wherein said step of supporting said whip antenna such that said whip antenna is in said first orientation includes the step of connecting said whip antenna to said third shaft.

19. The method of claim 18, wherein said first, second and third shafts are welded to each other.

20. An HF radio transmission system, comprising:

(a) a whip antenna;

(b) generating means for generating HF radio waves; and (c) an adapter for selectively supporting said whip antenna in first and second positions and for electrically connecting said whip antenna to said generating means, wherein said first position is a near-horizontal position for NVIS transmission, and wherein said second position is a generally vertical position for surface wave communications transmission or for vertically polarized low angle, long distance (beyond 300 miles) skywave communication; and wherein said adapter includes a first shaft and second shaft for supporting said whip antenna in said first position, said second shaft being connected to said first shaft; and wherein said adapter further includes a third shaft for supporting said whip antenna in said second position, said third shaft being connected to said first shaft, and wherein said first, second and third shafts are integral with each other.

21. The system of claim 20, wherein said first, second and third shafts are welded to each other.

22. A method of using a whip adapter, wherein said adapter comprises: a) a first shaft having a lower end and an upper end; b) a second shaft extending distally from said upper end of said first shaft, said second shaft having a first end distal from said first shaft; c) means for securing said first shaft to said second shaft; d) means for securing said lower end of said first shaft to an antenna base; e) a first antenna port located at said distal end of said second shaft, said first antenna port including means for securing a whip antenna to said distal end of said second shaft, and wherein said means for securing said lower end of said first shaft to the antenna base is compatible with said means for securing the whip antenna to said distal end of said second shaft, whereby the whip antenna is securable directly to the antenna base; f) means for establishing electrical connectivity between said port and the antenna base; and g) means for positioning said second shaft relative to said first shaft, said positioning means being located at said upper end of said first shaft; and wherein the whip antenna is designed for use in the 2–30 MHz HF radio band; and wherein said method comprises the steps of:

using said adapter to connect said whip antenna to said antenna base;

using said second shaft to support said whip antenna in a near-horizontal position;

while said whip antenna is supported in said near-horizontal position, performing NVIS radio wave propagation by propagating HF radio waves from said whip antenna; and using said second shaft to support said whip antenna in a generally vertical position.

23. A method of using a whip tilt adapter, wherein said adapter comprises: a first member having a lower end and an upper end; a second member extending distally from said upper end of said first member, said second member having a first end distal from said first member; means for pivotably securing said second member to said first member; a first antenna port located at said distal end of said second member; and means for positioning said second member in at least first and second positions relative to said first member, and said second member being arranged to support a whip antenna in a near-horizontal position for NVIS HF radio wave propagation when said second member is in said first position relative to said first member, said second member being arranged to support the whip antenna in a generally vertical position for surface wave communications transmission or for vertically polarized low angle long distance skywave propagation when said second member is in said second position relative to said first member, said positioning means being located at said upper end of said first member, and wherein said positioning means comprises a plate, a plurality of holes extending through said plate, at least one hole extending through said second member, and a pin for extending through said hole of said second member and through a selected one of said holes of said plate so as to selectively maintain said second member in a desired orientation with respect to said first member, said plate being fixedly connected to said first member; and wherein said method includes the steps of:

using said second member to support said whip antenna in said near-horizontal position;

while said whip antenna is supported in said near-horizontal position, performing NVIS radio wave propagation by propagating HF radio waves from said whip antenna; and using said second member to support said whip antenna in said generally vertical position.

* * * * *